US008038241B2

(12) United States Patent
Sugahara

(10) Patent No.: US 8,038,241 B2
(45) Date of Patent: Oct. 18, 2011

(54) INKJET RECORDING DEVICE

(75) Inventor: Hiroto Sugahara, Aichi-ken (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 550 days.

(21) Appl. No.: 12/053,543

(22) Filed: Mar. 21, 2008

(65) Prior Publication Data

US 2008/0238961 A1 Oct. 2, 2008

(30) Foreign Application Priority Data

Mar. 30, 2007 (JP) ..... 2007-092735

(51) Int. Cl.
*B41J 2/01* (2006.01)
*B41J 29/38* (2006.01)
*B41J 2/015* (2006.01)

(52) U.S. Cl. ..... 347/9; 347/104; 347/16; 347/20

(58) Field of Classification Search ..... None
See application file for complete search history.

(56) References Cited

U.S. PATENT DOCUMENTS

| | | | | |
|---|---|---|---|---|
| 6,474,387 | B1 | 11/2002 | Shimao | |
| 6,729,376 | B1 | 5/2004 | Kakinuma et al. | |
| 6,758,471 | B2 * | 7/2004 | Hirako | 271/258.01 |
| 2004/0085386 | A1 * | 5/2004 | Yamamura | 347/19 |
| 2007/0019053 | A1 * | 1/2007 | Sato et al. | 347/104 |

FOREIGN PATENT DOCUMENTS

| | | | |
|---|---|---|---|
| JP | H10-087148 | A | 4/1998 |
| JP | H11-071058 | A | 3/1999 |
| JP | H11-255410 | A | 9/1999 |
| JP | 2000-255880 | A | 9/2000 |
| JP | 2002-046308 | A | 2/2002 |
| JP | 2003-011436 | A | 1/2003 |
| JP | 2003-011437 | A | 1/2003 |
| JP | 2006021449 | A | 1/2006 |
| WO | 9922359 | A1 | 5/1999 |
| WO | 0071362 | A1 | 11/2000 |

OTHER PUBLICATIONS

European Patent Office; European Search Report in Application No. 08005823.3 (counterpart to the above-captioned U.S. patent application) Communication pursuant to Rule 62 EPC mailed Oct. 23, 2009.
Japan Patent Office, Office Action for Japanese Patent Application No. 2007-092735 (counterpart to above-captioned patent application), dated Apr. 5, 2011.
Japan Patent Office, Decision to Grant for Japanese Patent Application No. P2007-092735 (counterpart to above-captioned patent application), mailed Aug. 2, 2011.

* cited by examiner

*Primary Examiner* — Stephen Meier
*Assistant Examiner* — Alexander C Witkowski
(74) *Attorney, Agent, or Firm* — Baker Botts L.L.P.

(57) ABSTRACT

An inkjet recording device according to an aspect of the invention comprises: an ejection head configured to eject ink on a recording medium; a conveying unit configured to convey the recording medium on a conveying path, the conveying path including a first conveying path positioned where the ejection head forms an image on the recording medium and extending along a first direction; an attaching unit configured to attach a second recording medium having an adherable part adherable to the recording medium such that a part of the second recording medium projects from an end portion of the recording medium with respect to a second direction perpendicular to the first direction. The ejection head is configured to record an image on the second recording medium in a position outside the recording medium with respect to the second direction.

14 Claims, 13 Drawing Sheets

INKJET RECORDING DEVICE

CROSS-REFERENCE TO RELATED APPLICATIONS

This application is based upon and claims the benefit of priority from Japanese Patent Application No. 2007-092735, filed on Mar. 30, 2007, the entire contents of which are incorporated herein by reference.

TECHNICAL FIELD

The present invention relates to an inkjet recording device in which a recording medium piece can be attached to a recording medium on which an image is formed by ink ejected from an ejection head.

BACKGROUND

An inkjet recording device can form (print) images on a plurality of recording papers by ejecting ink from an ejection head, and recording papers on which images are formed are sequentially stacked in a sheet discharging tray. In recent years, the inkjet recording device is connectable to a plurality of personal computers. Therefore, different documents may be printed in response to requests from the users. In this case, recording papers, on which the different documents are individually printed, are stacked in the sheet discharging tray. When an inkjet recording device has a FAX function in addition to recording papers on which documents from personal computers are printed, recording papers, on which documents received through the FAX function are printed, are also stacked in the sheet discharging tray.

When the recording papers (printed matters) on which the plurality of documents are individually printed are stacked in a stack in this way, some time is taken for the individual users to sort out the stacked recording papers to pick up their own desired recording paper or papers therefrom. To cope with this, there have been proposed in which paper pieces such as printed tags are attached to recording papers so as to facilitate the sorting out of the respective documents in the stack of recording papers stacked in the sheet discharging tray (see JP-A-10-87148 and JP-A-2006-21449).

According to the invention disclosed in JP-A-10-87148, however, since an ejection head for forming images on recording papers and an ejection head for performing printing on tags are provided separately, it is difficult to meet demands for reduction in size of a main body of a printer and production cost of the printer.

JP-A-2006-21449 discloses a laser printer including a photosensitive drum, in which images are formed both on recording papers and paper pieces which are attached thereto. However, since the printer is the laser printer, the position to attach paper pieces to recording papers needs to be positioned at an upstream side in a conveying direction of recording papers relative to an image forming position where the photosensitive drum is provided. In reality, according to the configuration disclosed in JP-A-2006-21449, the position where paper pieces are attached to recording papers is set to a position which is largely spaced away from the photosensitive drum and towards the upstream side. Since a recording paper needs to travel to the photosensitive drum with a paper piece attached thereto, the paper piece may be separated from the recording paper halfway to the photosensitive drum.

SUMMARY

An object of an aspect of the invention is to provide an inkjet recording device capable of reducing the size of a main body of the device as well as production cost of the device and also preventing the removal of a second recording medium attached to a recording medium by providing an image forming position and an attaching position of the second recording medium near to each other.

According to an aspect of the invention, there is provided an inkjet recording device comprising: an ejection head configured to eject ink on a recording medium to form an image; a conveying unit configured to convey the recording medium on a conveying path, the conveying path including a first conveying path positioned where the ejection head forms the image on the recording medium and extending along a first direction; an attaching unit configured to attach a second recording medium having an adherable part adherable to the recording medium such that a part of the second recording medium projects from an end portion of the recording medium with respect to a second direction perpendicular to the first direction; and a control unit configured to control the ejection head, the conveying unit, and the attaching unit, wherein the ejection head is configured to record an image on the second recording medium in a position outside the recording medium with respect to the second direction.

DESCRIPTION

Hereinafter, an inkjet recording device according to illustrative aspects of the invention will be described with reference to the drawings.

Figure 1:
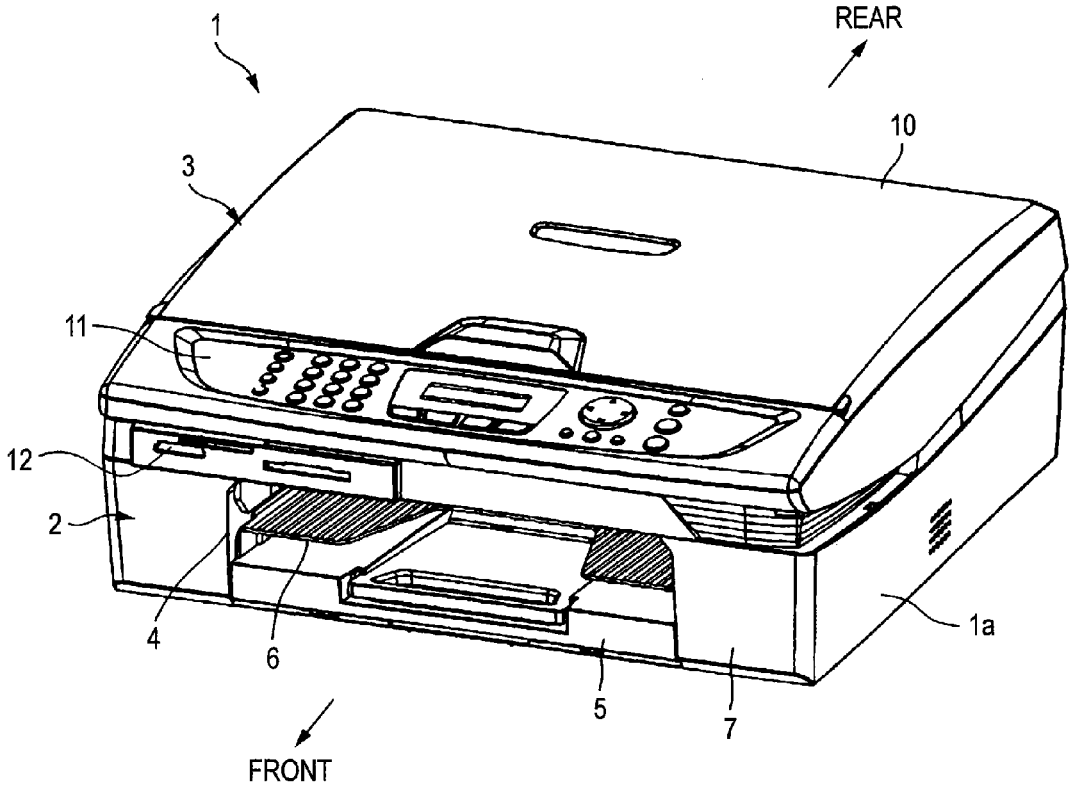
FIG. 1 is a perspective view showing an external configuration of an inkjet recording device according to an illustrative aspect of the invention.

FIG. 1 is a perspective view showing an external configuration of an inkjet recording device 1 according to an illustrative of the invention. In this illustrative aspect, a so-called multifunction device having a printer function, a scanner function, a copier function and a facsimile function is explained as the inkjet recording device 1. As shown in FIG. 1, a multifunction device as the inkjet recording device 1 includes: a substantially rectangular parallelepiped housing 1*a*; a printer unit 2 configured to record an image by an inkjet method and provided in a lower portion of the housing 1*a*; and a scanner unit 3 provided in an upper portion of the housing 1*a*.

As shown in FIG. 1, the printer unit 2 of the inkjet recording device 1 has an opening 4 in the front (a front side) of the housing 1*a*, and a lower sheet feeding tray 5 and an upper sheet discharging tray 6 are provided in two stages inside the opening 4. The sheet feeding tray 5 can accommodate a plurality of recording media such as recording papers P. For example, the sheet feeding tray allows recording papers P of various sizes equal to A4 size or smaller to be accommodated therein.

A door 7 is provided in a lower right portion on the front of the printer unit 2 and configured to freely open and close. A main tank mounting unit 8 configured to mount main tanks 9 (also referred to as ink cartridges) is provided inwards of the door 7 (refer to FIG. 2). Consequently, in a state where the door 7 is opened, the main tank mounting unit 8 becomes exposed to the front side of the printer unit 2, so that the main tanks 9 can freely be mounted to and removed from the main tank mounting unit 8. The main tank mounting unit 8 includes a plurality of accommodation chambers, and the number of the accommodation chambers corresponds to the number of colors of inks to be used. In this printer unit 2, inks of five colors are used and they are inks of cyan (C), magenta (M), yellow (Y) and photo black (PBk), which are dye inks, and black (Bk), which is a pigment ink. Consequently, five accommodation chambers are defined in the main tank mounting unit 8. The main tanks 9, in which inks of cyan (C), magenta (M), yellow (Y), photo black (PBk) and blak (Bk) are individually stored, are respectively accommodated in those five accommodation chambers.

The scanner unit 3 provided in the upper portion of the inkjet recording device 1 is configured as a so-called flatbed scanner. As shown in FIG. 1, a document cover 10 is provided on an upper surface of the inkjet recording device 1. The document cover 10 is provided as a top plate of the inkjet recording device 1 and configured to freely open and close. In addition, a platen glass (not shown) on which a document is placed, an image sensor (not shown) configured to read documents and images and the like are provided below the document cover 10.

An operation panel 11 is provided in the upper portion on the front of the inkjet recording device 1 to allow inputs to operate the printer unit 2 and the scanner unit 3. The operation panel 11 includes various control buttons and a liquid crystal display. The inkjet recording device 1 is operable based on instructions outputted from the operation panel 11 in response to the input from the user to the operation panel 11.

A slot portion 12 is provided in an upper left portion on the front of the inkjet recording device 1. Various types of recording media such as memory cards can be mounted into the slot portion 12. Data stored in a small memory cart mounted to the slot portion 12 can be read out in response to a predetermined operation on the operation panel 11. The read out data, such as images, can be displayed on the liquid crystal display on the operation panel 11. At least one of the displayed images are arbitrarily selectable, and the selected image can be recorded on a recording paper P by the printer unit 2.

Figure 2:
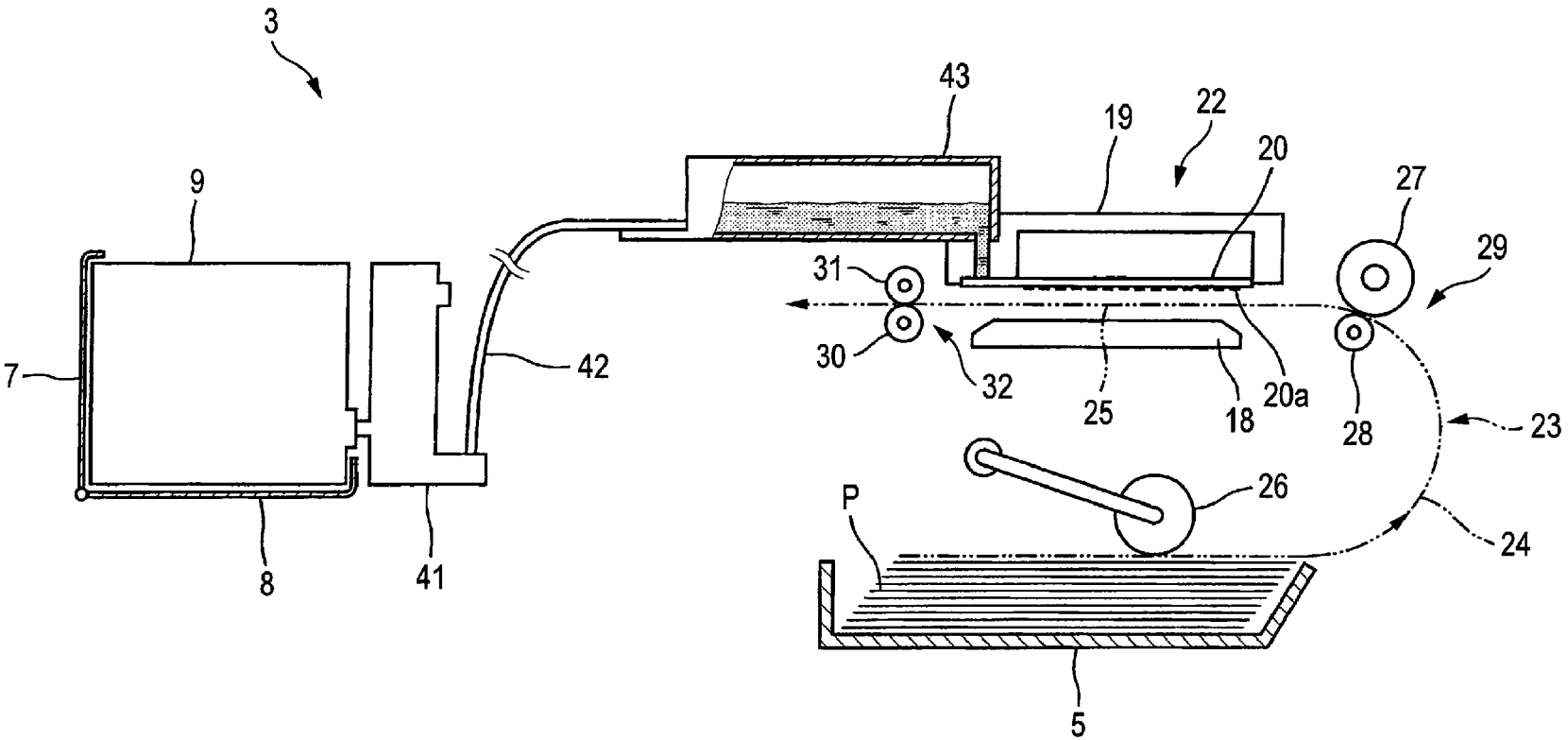
FIG. 2 is an exemplary cross-sectional view showing the configuration of a printer unit that the inkjet recording device shown in FIG. 1 includes.
Figure 3:
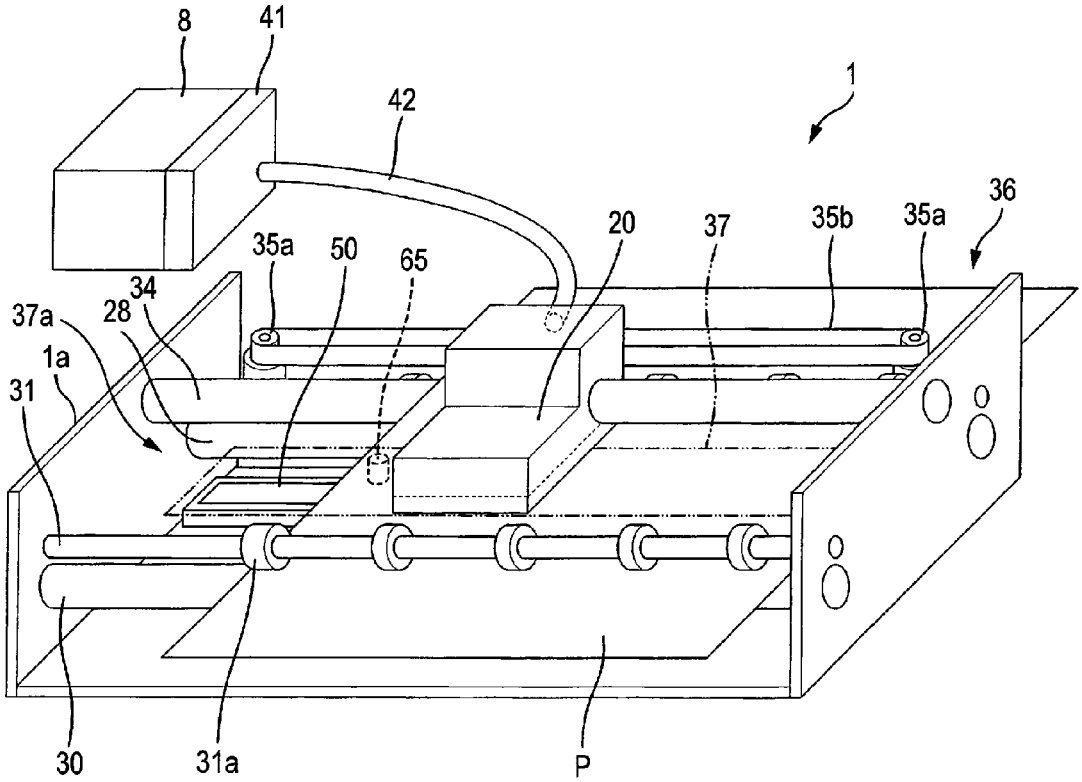
FIG. 3 is a perspective view showing exemplarily the configuration of the printer unit shown in FIG. 2.
Figure 4:
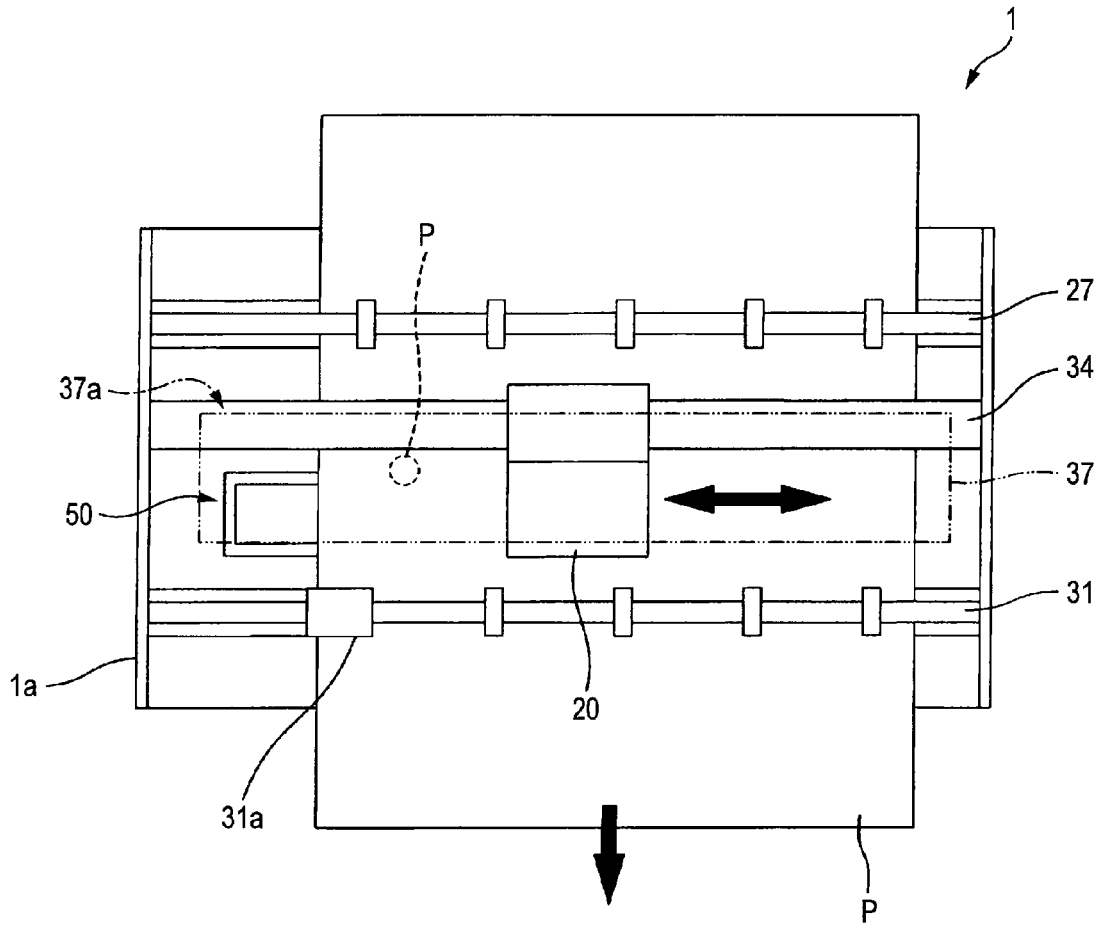
FIG. 4 is a plan view showing the configuration of the printer unit shown in FIG. 3.

FIG. 2 is an exemplary cross-sectional view showing the configuration of the printer unit 2, FIG. 3 is a perspective view showing exemplarily the configuration of the printer unit 2, and FIG. 4 is a plan view showing the configuration of the printer unit 2. As shown in FIG. 2, the sheet feeding tray 5 is provided in the vicinity of a bottom portion of the inkjet recording device 1, and a flat plate-shaped platen 18 is provided above the sheet feeding tray 5. The platen 18 has a relatively longer dimension along a right and left direction (hereinafter referred to as transverse direction). An image recording unit 22 is provided further above the platen 18 and includes an ejection head 20 for ejecting ink from nozzle holes 20*a* and the like which are on a carriage 19. In addition, a sheet conveying path 23 is provided to extend from the rear of the sheet feeding tray 5. This sheet conveying path 23 contains a curved path 24 and a straight path 25. The curved path 24 extends upwards from the rear of the sheet feeding tray 5 and curve to direct forwards. The straight path 25 extends further forwards from a terminating point of the curved path 24. The sheet conveying path 23 includes an external guide surface and an internal guide surface face each other with a predetermined space provided therebetween and provided at locations other than a position where the image recording unit 22 is provided.

A sheet feeding roller 26 is provided immediately above the sheet feeding tray 5 configured to feed a recording paper P stored in the sheet feeding tray 5 to the sheet conveying path 23. A conveying roller pair 29 including a pair of a conveying roller 27 and a pinch roller 28 is provided in the vicinity of a downstream portion of the curved path 24 of the sheet conveying path 23 and configured to hold the sheet conveying path 23 from top and bottom by both the rollers 27, 28 therebetween. Furthermore, a sheet discharging roller pair 32 including a pair of a sheet discharging roller 30 and a pinch roller 31 is provided in the vicinity of a downstream portion of the straight path 25 of the sheet conveying path 23 and configured to hold the sheet conveying path 23 from top and bottom by both the rollers 30, 31 therebetween. The ejection head 20 and the platen 18 are provided to sandwich the straight path 25 from top and bottom and provided between the conveying roller pair 29 and the sheet discharging roller pair 32. A conveying unit configured to conveying recording papers P includes the sheet feeding roller 26, the conveying roller pair 29 and the sheet discharging roller pair 32.

In addition, as shown in FIG. 3, the ejection head 20 is slidably supported in the transverse direction by a guide rod 34 which extends in the transverse direction (a length direction of the platen 18). The ejection head 20 is connected to a belt 35*b* extended between pulleys 35*a* that is separated in the scanning direction. The pulleys 35*a* and the belt 35*b* are rotated freely clockwise and counterclockwise by driving a carriage motor 35 (refer to FIG. 6). A head drive unit 36 includes the carriage motor 35, the pulleys 35*a* and the belt 35*b*. In addition, the ejection head 20 is movable transversely (hereinafter, referred to as a "scanning direction") along the guide rod 34 within a predetermined range by the rotation of the carriage motor 35 as a result of the head drive unit 36 being driven.

Inks are supplied from the main tanks 9 mounted to the main tank mounting unit 8 to the ejection head 20 by way of an air-liquid separation sub-tank 41, a flexible ink tube 42 and a buffer tank 43 that is connected to an upper portion of the ejection head 20. Then, by driving an actuator (not shown) including a piezoelectric element provided in the ejection head 20, inks in the buffer tank 43 flow into the ejection head 20 and are discharged to the outside from the nozzle holes 20*a*.

In the printer unit 2 described above, a recording paper P stored in the sheet feeding tray 5 is fed to the sheet conveying path 23 by the sheet feeding roller 26, and thereafter the recording paper P is conveyed from the curved path 24 to the straight path 25 on the sheet conveying path by the conveying roller pair 29. Here, an image is recorded on the recording paper P that has reached the straight path 25 by inks ejected from the nozzle holes 20*a* of the ejection head 20 which is disposed to face the recording paper P. When the recording is completed, the recording paper P is discharged from the straight path 25 to the sheet discharging tray (see FIG. 1) by the sheet discharging roller pair 32.

In this way, an area on the straight path 25 which the ejection head 20 faces is defined as an image forming area 37 (refer to FIG. 4) where an image can be formed by inks ejected from the ejection head 20. When inks are ejected from the ejection head 20 in a state where the recording paper P stays in the area 37, an image can be formed on the recording paper P. As shown in FIGS. 3 and 4, this image forming area 37 is set to include a projecting area 37*a* projecting from one end portion of the recording paper P on the platen 18, more particularly, one end portion with respect to a traversing direction of the ejection head 20. As will be described later, a paper piece attaching unit 50 is provided so that at least a part of the piece attaching unit 50 overlaps with a projecting area 37*a* as viewed from the top. The paper piece attaching unit 50 is configured to attach a second recording medium such as the paper piece 53 to the recording paper P.

(Configuration of the Paper Piece Attaching Unit)

Figure 5:
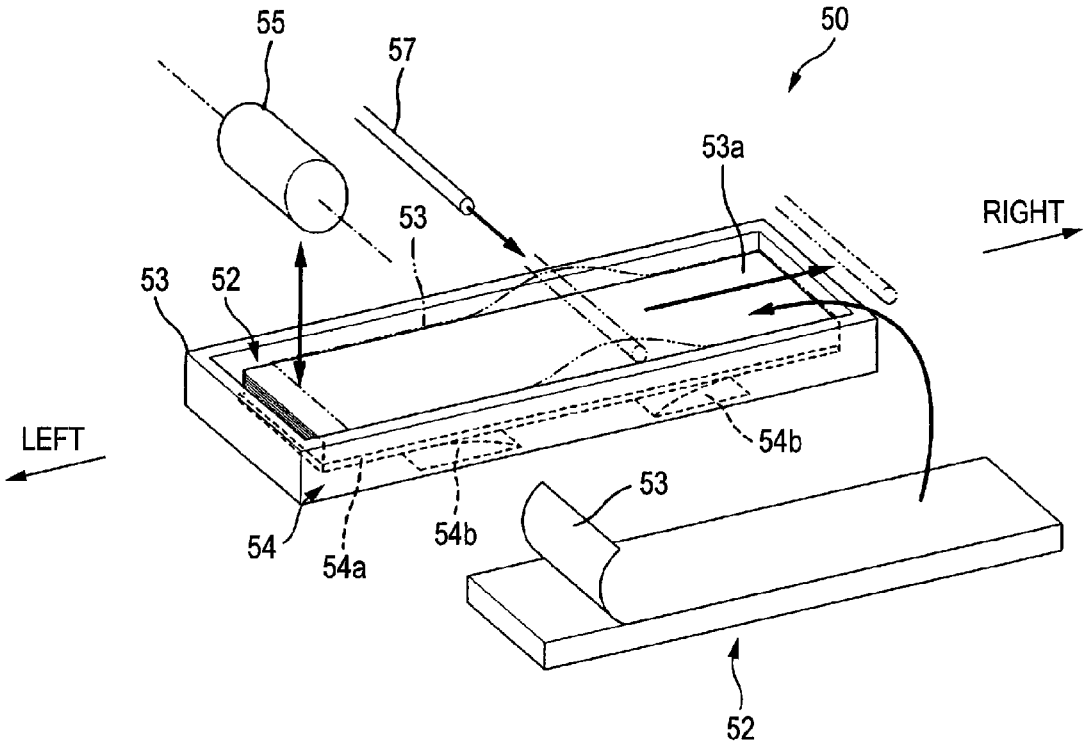
FIG. 5 is an exemplary perspective view which explains the configuration and operation principle of a paper piece attaching unit that the inkjet recording device includes.

FIG. 5 is an exemplary perspective view showing the configuration and operation principle of the paper piece attaching unit 50. As shown in FIG. 5, the paper piece attaching unit 50 includes a paper piece accommodation portion 51 configured to accommodate a paper piece stack 52. The paper piece accommodation portion 51 has a substantially rectangular parallelepiped shape which is a relatively longer dimension along the transverse direction. The paper piece accommodation portion 51 has an opening facing upwards.

This paper piece stack 52 includes a plurality of stacked rectangular paper pieces 53 having the same dimensions, and an adhesive material is applied to one end portion 53*a* on an upper face of each paper piece 53 (that is, a surface which becomes exposed in such a state where the paper piece 53 is accommodated in the paper piece accommodation portion 51), whereby the paper piece 53 is joined to another paper piece 53 which is adjacently stacked on the top of the paper piece 53. However, an adhesion force of the adhesive material is relatively weak and hence, paper pieces 53, 53 which are bonded together can be separated from each other relatively easily. As the paper piece 53, widely marketed sticky notes may be used.

In an inner bottom portion of the paper piece accommodation portion 51, a bottom lifting portion (a drive portion) 54 is provided to adjust the height of the paper piece stack 52 accommodated in the paper piece accommodation portion 51. This bottom lifting portion 54 includes: a placement plate 54*a* on which the paper piece stack 52 is placed; and an elastic member 54*b* provided between the placement plate 54*a* and an inner bottom surface of the paper piece accommodation portion 51 and including a leaf spring or the like. The elastic member 54*b* urges the placement plate 54*a* to direct the placement plate 54*a* upwards.

The paper piece stack 52 is accommodated in the paper piece accommodation portion 51 such that the end portion 53*a* where the adhesive material is applied comes near to the recording paper P on the platen 18 (see FIG. 4), and the paper piece stack 52 is placed on an upper surface of the placement plate 54*a* of the bottom lifting portion 54. Then, the elastic member 54*b* is deformed by the own weight of the paper piece stack 52, and the paper piece stack 52 is lowered together with the placement plate 54*a* and stops in a predetermined position. On the other hand, when paper pieces 53 in an uppermost portion of the paper piece stack 52 are sequentially fed therefrom, the own weight of the paper piece stack 52 is reduced, whereby the paper piece stack 52 is raised together with the placement plate 54*a* by virtue of the urging force of the elastic member 54*b*. As a result, irrespective of the number of paper pieces 53 included in the paper piece stack 52, an uppermost surface of the paper piece stack 52 is adjusted to a substantially constant height from the inner bottom surface of the paper piece accommodation portion 51.

A rotor (a sliding contact unit) 55 is provided above the paper piece accommodation portion 51 and rotatable about an axial center which is oriented in the length or longitudinal direction of the device. The rotor 55 is configured to rotate and be lifted and lowered by an actuator 56 (see FIG. 6). This rotor 55 is allowed to be lowered until it is brought into contact with a top paper piece 53 of the paper piece stack 52 from above and can bend the paper piece 53 as indicated by a chain double-dashed line in FIG. 5 by being rotated in a state where the rotor 55 is in contact with the paper piece 53.

Furthermore, the paper piece attaching unit 50 includes an inserting rod 57. This inserting rod 57 is normally retracted at the rear of the paper piece accommodation portion 51 as a stand-by position and is configured to move forwards and then sideways from the stand-by position, as well as move back to the stand-by position by another actuator 58 (see FIG. 6). Consequently, when the actuator 58 is driven to move the inserting rod 57 forwards in a state where the paper piece 53 is bent by the rotor 55, the inserting rod 57 is inserted below a bent portion of the paper piece 53. Next, the inserting rod 57 is moved in a direction towards the end portion 53*a* on the paper piece 53 where the adhesive material is applied (rightwards as viewed in FIG. 5), the paper piece 53 is detached from a paper piece 53 directly therebelow to which the paper piece 53 has been bonded until then.

As shown in FIG. 4, the paper piece attaching unit 50 is provided such that the end portion 53*a*, where the adhesive material is applied, of a paper piece 53 accommodated in the paper piece accommodation portion 51 is situated below a side end portion of the recording paper P. Then, by driving the respective actuators 56, 58, the paper piece 53 can be attached to a rear surface of the recording paper P as will be described later.

(Functional Block Diagram)

Figure 6:
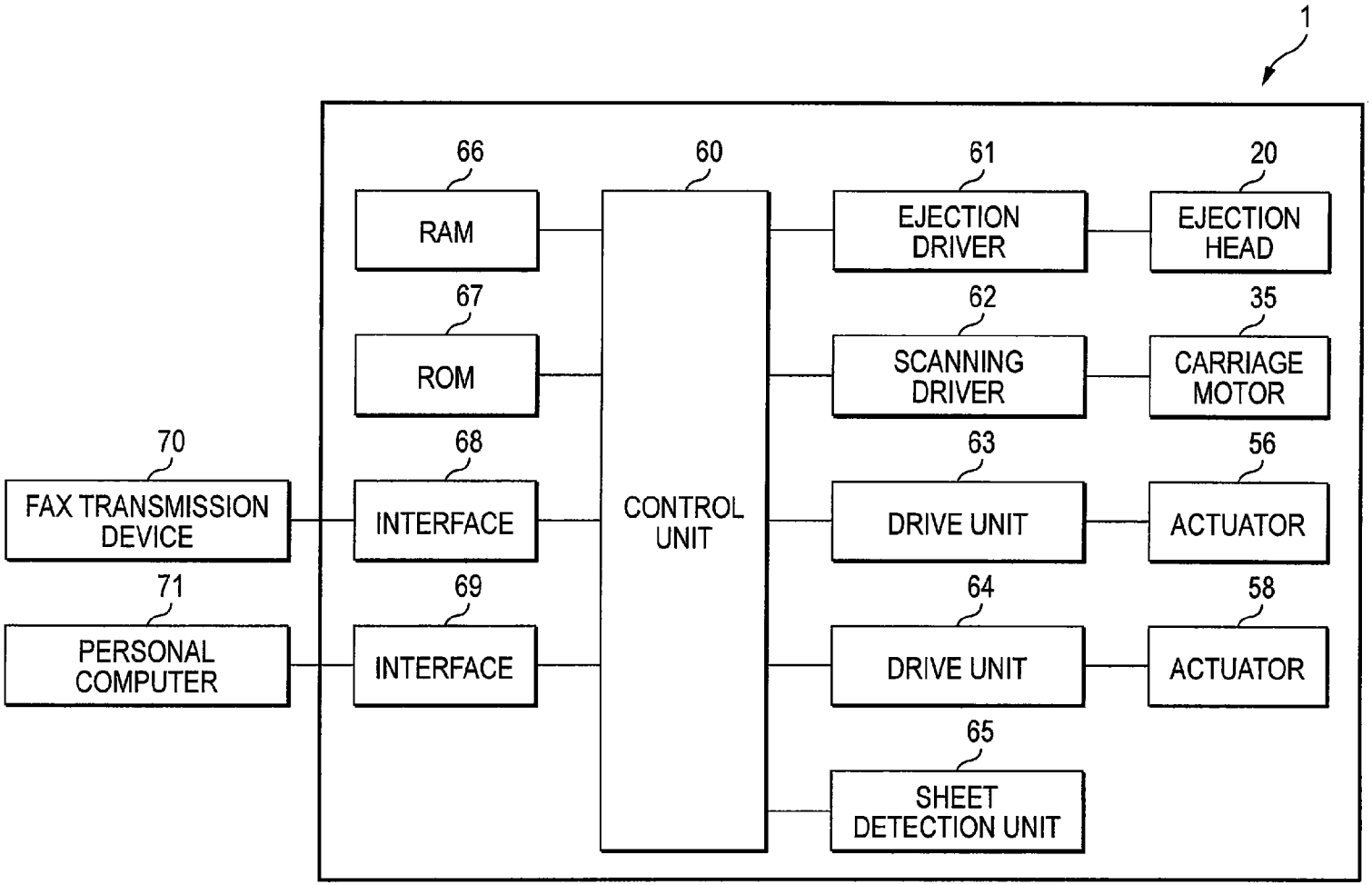
FIG. 6 is a block diagram which explains the function of the inkjet recording device.

FIG. 6 is a block diagram for explaining the function of the inkjet recording device 1 described above. As shown in FIG. 6, the inkjet recording device 1 includes a control unit 60, and the ejection head 20 described above is connected to the control unit 60 via an ejection driver 61, and the carriage motor 35 configured to scan the ejection head 20 connected to the control unit 60 via a scanning driver 62. Consequently, the ejection driver 61 outputs a drive signal based on a control signal from the control unit 60, and the ejection head 20 ejects predetermined amounts of inks at predetermined timings based on the drive signal outputted from the ejection driver 61. In addition, the scanning driver 62 outputs a drive signal based on a control signal from the control unit 60, and the carriage motor 35 is driven in a rotational direction, at a rotational speed and through a predetermined rotational angle which are specified by the drive signal outputted from the traverse driver 62. As a result, the ejection head 20 moves in connection with the carriage motor 35 to thereby move in the traversing direction.

The actuators 56, 58 contained in the paper piece attaching unit 50 are connected to the control unit 60 via drive units 63, 64, respectively. Both the drive units 63, 64 are configured to output drive signals to drive the actuators 56, 58 based on control signals from the control unit 60. As described before, when this drive signal is inputted to the actuator 56, the actuator 56 rotates and lifts and lowers the rotor 55 provided on the paper piece attaching unit 50. When this drive signal is inputted to the actuator 58, the actuator 58 moves horizontally the inserting rod 57 in the longitudinal direction, as well as the transverse direction.

In addition, a sheet position detection unit 65 is connected to the control unit 60. The sheet position detection unit 65 is configured to detect a position on a recording paper P where a paper piece 53 is to be attached. As shown in FIGS. 3 and 4, this sheet position detection unit 65 is provided in the vicinity of the paper piece accommodation portion 51 provided on the paper piece attaching unit 50 and upstream of the paper piece accommodation portion 51 in the conveying direction of recording papers P. Information on the position on the recording paper P detected by the sheet position detection unit 65 is outputted to the control unit 60, and the control unit 60 measures a timing at which a paper piece 53 is attached to the recording paper P and drives the paper piece attaching unit 50. In place of the sheet position detection unit 65, potentiometers may be provided on the conveying roller pair 29 and the sheet discharge roller pair 32, so that a position on a recording paper P where a paper piece 53 is to be attached may be detected based on outputs from the potentiometers.

A RAM 66 and a ROM 67 are connected to the control unit 60. The RAM 66 is configured to temporarily storing the result of an operation. The ROM 67 is configured to record programs control the operations of the inkjet recording device 1. The control unit 60 can execute all the operations of the inkjet recording device 1 according to the programs in the ROM 67, and an operation result generated each time the operation is executed is temporarily stored in the RAM 66.

A Fax transmission device 70 and a personal computer 71 are connectable to the control unit 60 via interfaces 68, 69, respectively. Consequently, the control unit 60 scans the ejection head 20 and causes inks to be ejected therefrom, so as to form an image on a recording paper P based on a signal received from the FAX transmission device 70 or the personal computer 71 via the interface 68 or 69, and furthermore, an image can be also formed on a paper piece 53 as will be described later.

(Description of Operation)

Figure 7:
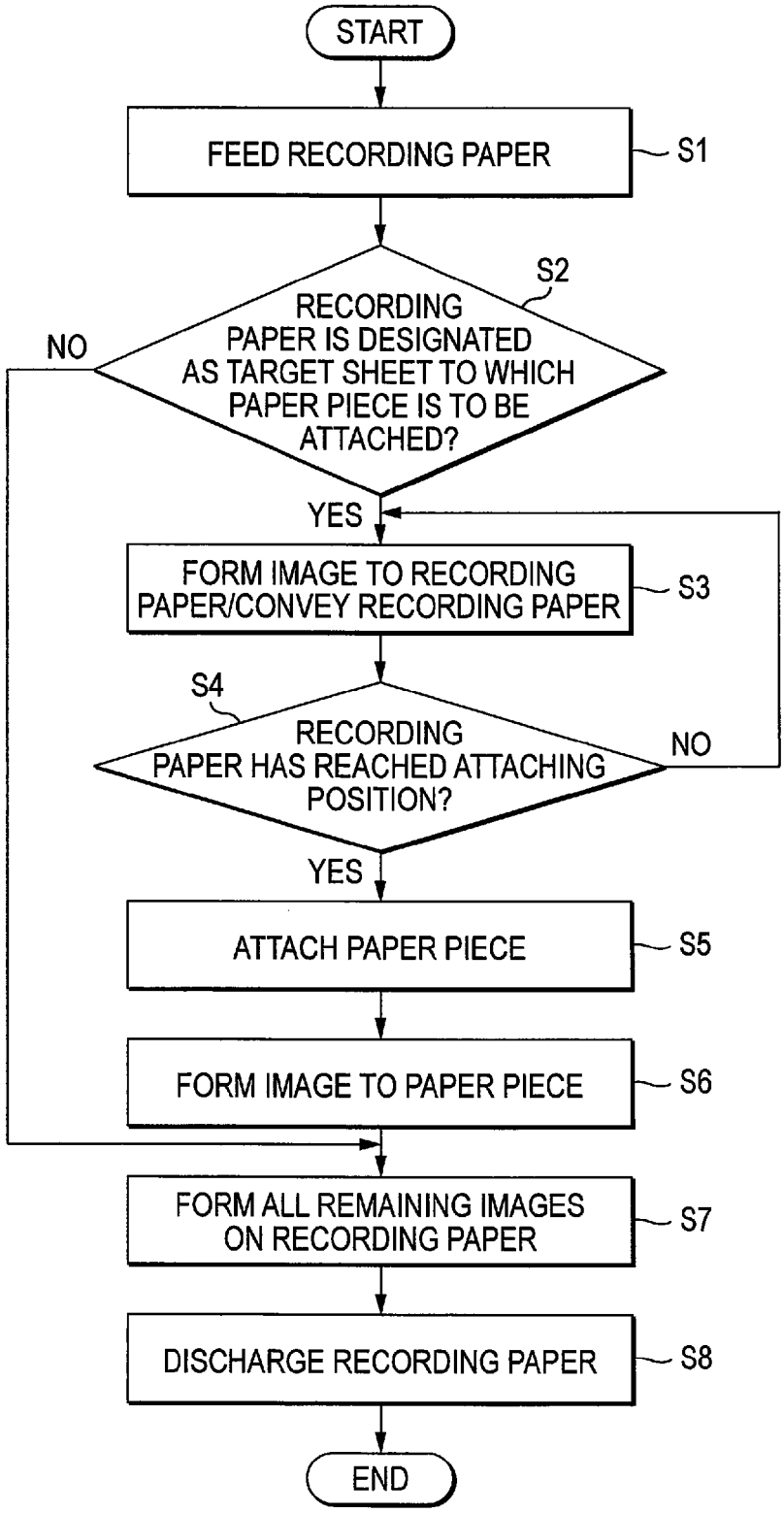
FIG. 7 is a flowchart which describes the operation of the inkjet recording device and shows an operation of forming an image on a paper piece which is attached to a recording paper.

FIG. 7 is a flowchart for describing the operation of the inkjet recording device 1 described above and shows an operation of forming an image on a paper piece 53 attached to a recording paper P. As shown in FIG. 7, the inkjet recording device 1 feeds a recording paper P from the sheet feeding tray 5 along the sheet conveying path 23, so as to convey the recording paper P to the image forming area 37 (S1). The control unit 60 judges whether or not the recording paper P on which an image is to be formed next is a target recording paper P to which a paper piece 53 is attached (S2), and if it is determined that the recording paper P is not a target recording paper to which a paper piece 53 is attached (S2: NO), while the recording paper P is conveyed sequentially, inks are caused to be ejected from the ejection head 20, so as to form a required image on the recording paper P (S7), and the recording paper P is discharged into the sheet discharging tray 6 when the image formation has been completed (S8).

On the other hand, if it is determined at step 2 that the recording paper P is a target recording paper to which a paper piece 53 is to be attached (S2: YES), a required image continues to be formed on the recording paper P while the recording paper P is being conveyed until the recording paper P reaches a predetermined position (S3). Next, it is determined whether or not the recording paper P has reached a position where a paper piece 53 is to be attached thereto based on a signal from the sheet position detection unit 65 (S4), and if it is determined that the recording paper P has not yet reached the attaching position (S4: NO), the operations at steps 3 to 4 are repeated. If it is determined that the recording paper P has reached the attaching position (S4: YES), the paper piece attaching unit 50 is driven, so as to attach a paper piece 53 to a rear surface of the recording paper P (S5).

FIGS. 8A to 8E show drawings for explaining the operation of the paper piece attaching unit 50 in attaching a paper piece 53 to a recording paper P. At step 5 in FIG. 7, firstly, the control unit 60 drives the actuator 56 and lowers the rotor 55 (see FIG. 8A), so as to bring the rotor 55 into contact with an upper surface of a paper piece 53 which is situated in an uppermost position of the paper piece stack 52. Following this, the control unit 60 rotates the rotor 55 in one direction, specifically, rotates by a predetermined angle in a direction in which a contact point of the rotor 55 to the paper piece 53 approaches the end portion 53*a* side of the paper piece 53 where the adhesive material is applied (see FIG. 8B). As a result, since the rotor 55 rotates to slide-contact the upper surface of the paper piece 53, the paper piece 53 deflects such that both ends thereof approach each other and a halfway portion is bent upwards.

Figure 8A:
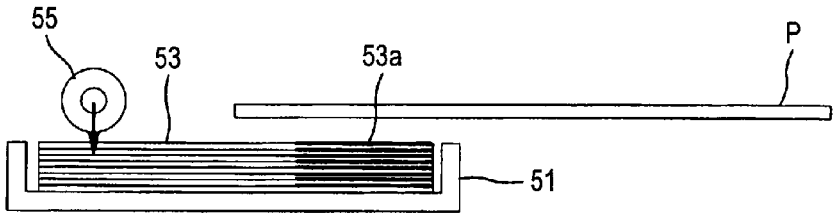
FIGS. 8A to 8E are diagrams which explain the operation of a paper piece attaching unit in attaching a paper piece to a recording paper.
Figure 8B:
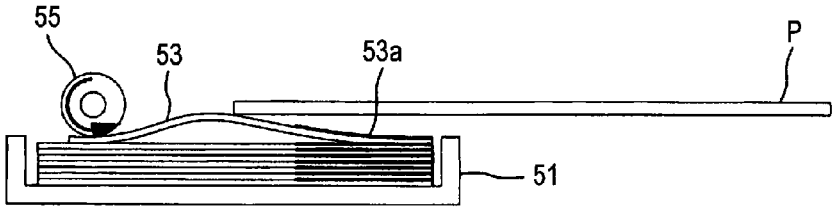
Figure 8C:
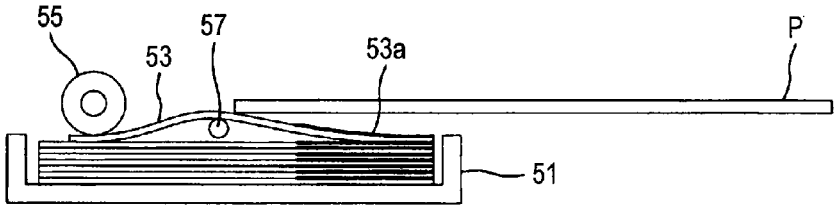
Figure 8D:
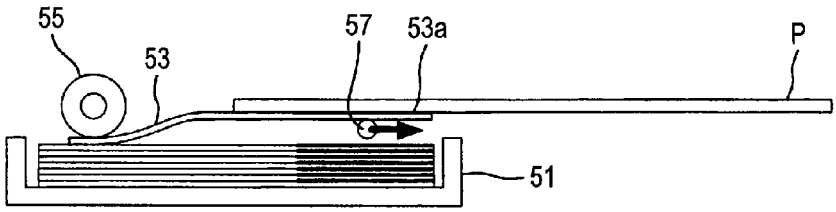
Figure 8E:
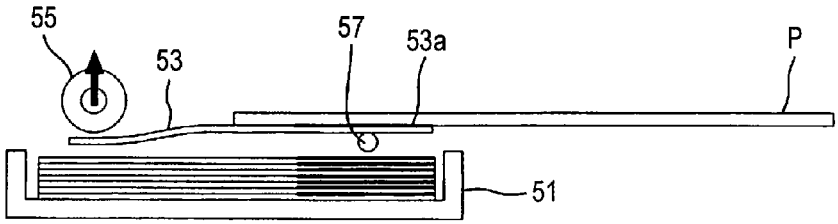

Next, the control unit 60 drives the actuator 58 to move forwards the inserting rod 57 which is standing by further rearwards than the paper piece accommodation portion 51 so that the inserting rod 57 is inserted below the bent portion (refer to FIG. 8C). In this state, the control unit 60 moves the inserting rod 57 towards the end portion of the paper piece 53 where the adhesive material is applied, whereby the paper piece 53 is detached from a paper piece 53 which lies directly thereunder and is then attached to an end portion on a rear surface side of the recording paper P by means of the adhesive applied to the end portion 53*a* on the upper surface of the paper piece 53 (FIG. 8D). Then, when the attachment of the paper piece 53 to the recording paper P, the control unit 60 drives the actuator 56 to lift the rotor 55 to cause it to stand by in the original position (FIG. 8E). In addition, the paper piece 53 is kept pressed from above by the rotor 55 during the operation of the inserting rod 57, which suppresses the generation of a positional registration error of the paper piece 53.

When the attachment at step 5 is completed in this way, the control unit 60 allows a required image to be formed on the paper piece 53 which is now attached to the recording paper P (S6). Thereafter, the control unit 60 allows a further required image, which still remains, to be formed on the recording paper P while conveying the recording paper P (S7). When the formation of all the required images is completed, the control unit 60 discharge the recording paper P into the sheet discharging tray 6 (S8), and the series of operations being ended. As shown in FIGS. 3 and 4, the sheet discharging roller pair 32 includes a wide roller element 31*a* provided on the pinch roller 31 which is configured to press down a side end portion of the recording paper P from above. Consequently, as the recording paper P is conveyed after the paper piece 53 has been attached thereto, the end portion 53*a* of the paper piece 53 where the adhesive material is applied and the recording paper P are held to be bonded together by the roller element 31*a* and the sheet discharging roller 30, whereby the paper piece 53 is allowed to be attached to the recording paper P strongly and rigidly. According to this configuration, since the conveying unit configured to convey recording papers P can also be used as a device configured to bond the recording paper P and the end portion 53*a* of the paper piece 53, a reduction in production costs can be realized, compared to a case where a bonding device is provided exclusively.

Figure 9:
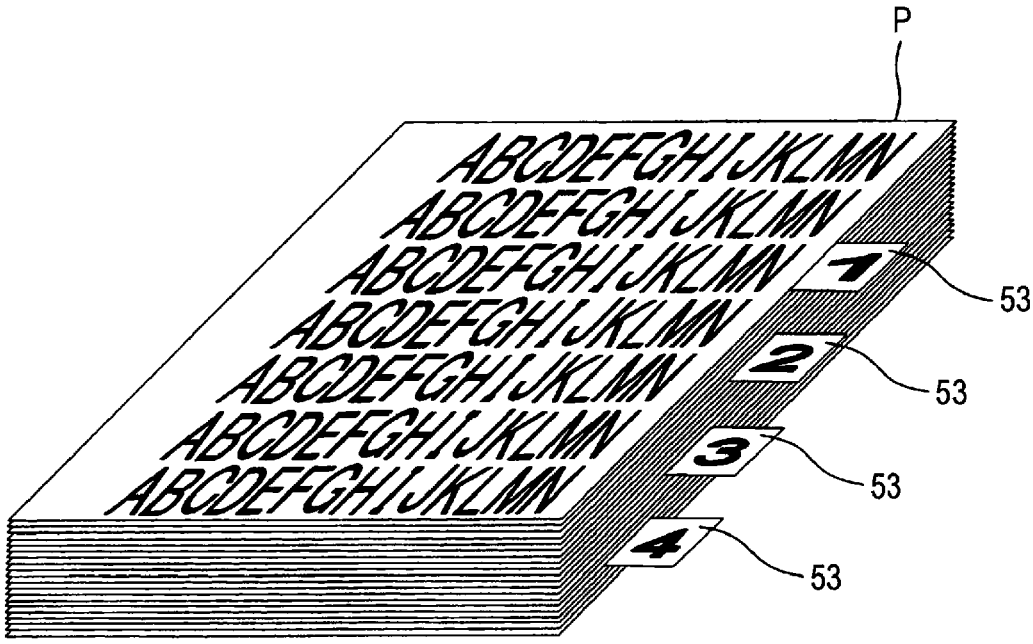
FIG. 9 is an exemplary perspective view showing an example of a stack of recording papers to which paper pieces are attached.

When images are formed on recording papers P for a plurality of documents in the way described above, and paper pieces 53 are attached to, for example, the recording papers P which correspond to initial pages of the respective documents, a stack of recording papers P as shown in FIG. 9 is stacked in the sheet discharging tray. As shown in FIG. 9, since the paper pieces 53 are attached to the recording papers P to project from end portions thereof, the respective documents are easily located, thereby making it possible to facilitate a sort-out operation.

The position where a paper piece 53 is attached to a recording paper P, that is, the attaching position on a recording paper P in the sheet conveying direction (a direction perpendicular to the traversing direction) can be changed as required by implementing a required setting. For example, the user can input attaching positions of paper pieces 53 in association with information on images to be formed on recording papers P from the personal computer 71, and the inputted attaching positions are stored in the RAM 66. Then, when determining at step 2 that a recording paper P is a recording paper P to which a paper piece 53 is to be attached, the control unit 60 reads out an attaching position from the RAM 66, and at step 4, the control unit 60 determines whether or not the recording paper P has reached a position where a paper piece 53 is attached thereto. In this way, by setting attaching positions of paper pieces 53 in the sheet conveying direction as required according to the preference of the user, as shown in FIG. 9, even though the stack of recording papers P are stacked in the sheet discharging tray 6, the respective documents are easily located, thereby making it possible to facilitate a sort-out operation.

Since the paper piece attaching unit 50 is provided within the image forming area 37, a paper piece 53 having just been attached to a recording paper P stays within the image forming area 37. Consequently, an image can be formed on the paper piece 53 which still stays where it has been attached to the recording paper P without moving the attached paper piece 53 together with the recording paper P. Moreover, since the same ejection head 20 is used for image formation on the paper piece 53 as well as for image formation on the recording paper P, a lower price and a smaller size can be realized for the resulting inkjet recoding device 1, compared to a case where separate ejection heads are provided individually for those image formations.

An image formation on the paper piece 53 is performed together with an image formation on the recording paper P. In detail, when an image is formed on the paper piece 53 and an image is also formed on the recording paper P in a position in the traversing direction which passes through the location where the paper piece 53 is attached thereto (that is, a position on the same scanning line as the attaching position on the recording paper P), images are formed sequentially on the recording paper P and the paper piece 53 through a scanning motion of the ejection head 20 in one direction along the scanning direction. Similarly, images are also sequentially formed on the recording paper P and the paper piece 53 through a scanning motion of the ejection head 20 in the other direction along the scanning direction. Thus, this configuration eliminates the necessity of performing a complex operation in which, for example, after a required image is formed on the recording paper P, the recording paper P is returned in an opposite direction to the conveying direction to form an image on the paper piece 53. In addition, shortening the time taken to complete image formations on the recording paper P and the paper piece 53 can be realized.

According to the operations shown in FIG. 7, an image is formed on the paper piece 53 attached to the recording paper P. By adopting this configuration, since the upper surface of the attached paper piece 53 is substantially flush with the upper surface of the recording paper P, a spaced distance between the ejection head 20 and the paper piece 53 is substantially equal to a spaced distance between the ejection head 20 and the recording paper P. Consequently, an accurate image can be formed on the paper piece 53 by inks ejected from the ejection head 20.

Figure 10:
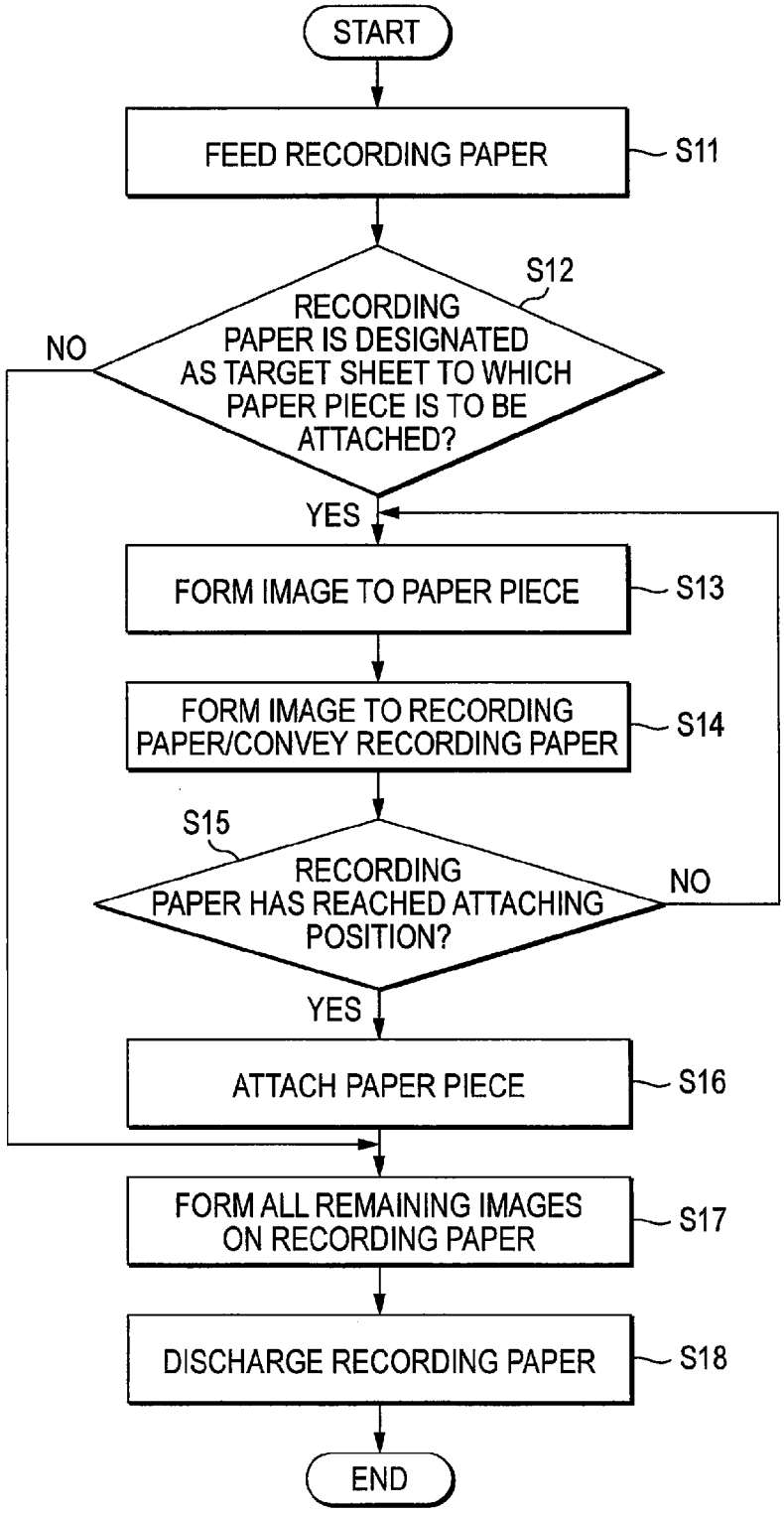
FIG. 10 is a flowchart which explains another operation of the inkjet recording device and shows an operation in which an image is formed on a paper piece before it is attached to a recording paper.

FIG. 10 is a flowchart for describing another operation of the inkjet recording device 1. In the operation shown in FIG. 10, an image is formed on a paper piece 53 before it is attached to a recording paper P. In the operations shown in FIG. 7, the operation of forming an image on the paper piece 53 is performed at step 6, after the paper piece 53 has been attached to the recording paper P. In contrast to this, the flow of operations shown in FIG. 10 differs from that shown in FIG. 7 in that an image is formed on a paper piece 53 before the paper piece 53 is attached to a recording paper P (S16), after a recoding paper P on which an image is to be formed next has been determined as a target recording paper to which a paper piece 53 is to be attached (S12: YES). Since steps S11, S12, S14 to S18 which show other operations than the above operation shown in FIG. 10 are respectively similar to the operations at steps S1 to S5, S7, S8 shown in FIG. 7, the detailed description thereof will be omitted here.

By attaching the paper piece 53 to the recording paper P after the image is formed on the paper piece 53 in advance, the image can be formed in a state where the paper piece 53 is accommodated in the paper piece accommodating portion 51 and is hence maintained in a stable posture. Consequently, an accurate image formation can be implemented.

Note that in the example shown in FIG. 10, although the image is formed on the paper piece 53 immediately after the recording paper P has been determined to be a target recording paper to which a paper piece 53 is to be attached, the invention is not limited to this particular sequence. Namely, the image may be formed at any timing as long as it has been formed on the paper piece 53 before it is attached to the recording paper P. For example, the image may be formed on the paper piece 53 at a timing immediately before the attachment of the paper piece 53 to the recording paper P, or the image may be formed on the paper piece 53 in advance before a recording paper P is detected as being a target recording paper P.

(Double-Side Printing Device)

The printer unit 2 provided in the inkjet recording device in the above example has been described as having the single-side printing function in which a recording paper P is discharged after an image is formed on only one side thereof. However, even when a printer 2 having a double-side printing function in which images can be formed on one side and the other side of a recording paper P is adopted as the printer unit 2 of the inkjet recording device 1, by providing a paper piece attaching unit 50 described above, a paper piece can be attached to a recording paper P. This will be described in detail below.

Figure 11:
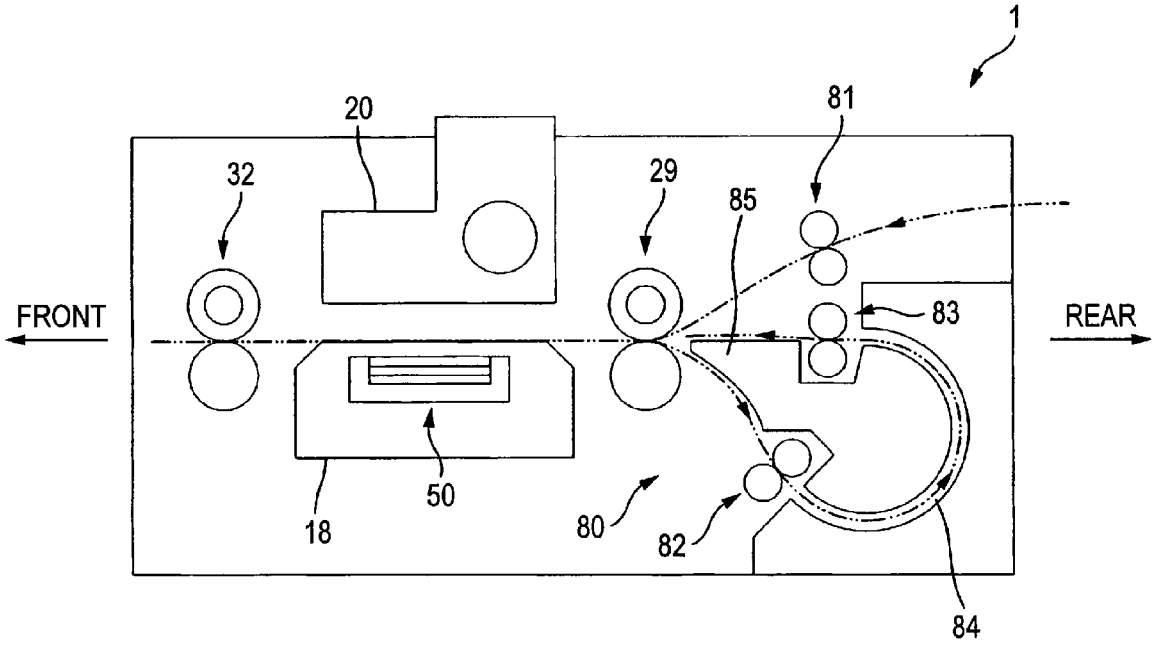
FIG. 11 is an exemplary diagram showing the configuration of a double-side printing machine which is adopted as an inkjet recording device.

FIG. 11 is an exemplary diagram showing the configuration of a double-side printing device which is adopted as an inkjet recording device 1. As shown in FIG. 11, the inkjet recording device 1 includes: similar to the inkjet recording device 1 shown in FIG. 2, a platen 18; an ejection head 20 disposed above the platen 18 to face the platen 18; and a conveying roller pair 29 and a sheet discharging roller pair 32 which are provided at the rear and front of the platen 18 and the ejection head 20. A paper piece 50 having a similar configuration of FIG. 5 is provided to a side (a near side of a paper piece of the sheet showing FIG. 11) of the platen 18. Note tat in the description regarding FIG. 11, a sheet discharging direction of a recording paper P which is finally discharged is described as front, while an opposite direction thereto is described as rear.

In addition to the elements described above, in the inkjet recording device 1 shown in FIG. 11, a first roller pair 81 is provided to the rear of the conveying roller pair 29, and a reversing mechanism 80 configured to reverse a recording paper P upside down is provided below the reversing mechanism 80. The conveying unit in this illustrative aspect includes the reversing mechanism 80 and first roller pair 81, in addition to the sheet feeding roller 26, the conveying roller pair 29 and the sheet discharging roller pair 32. This reversing mechanism 80 includes a second roller pair 82 provided in a lower portion of the reversing mechanism 80, a third roller pair 83 provided in an upper portion of the reversing mechanism 80 and to the rear of the conveying roller pair 29, a reversing path 84 through which a recording paper P can be reversed upside down, and, a guide 85 configured to guide the recording paper P conveyed to the rear from the conveying roller pair 29 to the second roller pair 82 and also guide the recording paper P conveyed to the front by the third roller pair 83 to the conveying roller pair 29 again.

An entrance and exit of the reversing path 84 are both oriented to the front, and the second roller pair 82 is provided in the vicinity of the entrance of the reversing path 84 to guide the recording paper P into the reversing path 84, while the third roller pair 83 is provided in the vicinity of the exit of the reversing path 84 to guide the recording paper P from the reversing path 84 to the conveying roller pair 29. Consequently, the recording paper P guided from the entrance into the reversing path 84 by the second roller pair 82 moves along the path and is further guided to be fed out from the path by the third roller pair 83 provided in the vicinity of the exit of the reversing path 84. As a result, the recording paper P is reversed upside down during a period of time from the recording paper P enters the reversing path 84 until it has exited from the same path. A traveling path of the recording paper P until it has been turned upside down is shown by chain double-dashed lines in FIG. 11.

In the inkjet recording device 1 which includes the printer unit 2 having the double-side printing function, since other configurations which are not shown in FIG. 11 are similar to the configurations shown in FIGS. 1 to 6 and which have already been described, the detailed description thereof will be omitted here.

Next, the operation of the inkjet recording device 1 having the double-side printing function which is configured as has been described above will be described. FIGS. 12A to 12D and 13A to 13D show exemplary diagrams for describing operations of forming images on both sides of a recording paper P and attaching a paper piece 53 to the recording paper P which are performed in the inkjet recording device 1. Each of 12A to 12D and 13A to 13D shows a condition in the middle of the respective operations.

Figure 12A:
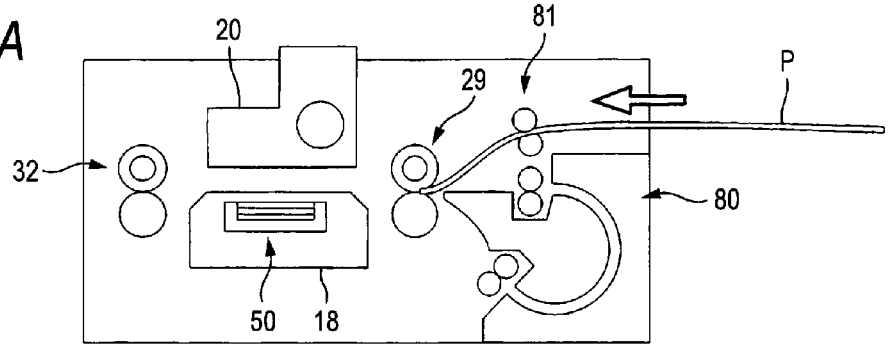
FIGS. 12A to 12D are exemplary diagrams which explain operations performed in the inkjet recording device shown in FIG. 11 when images are formed on both sides of a recording paper and a paper piece is attached thereto.
Figure 12B:
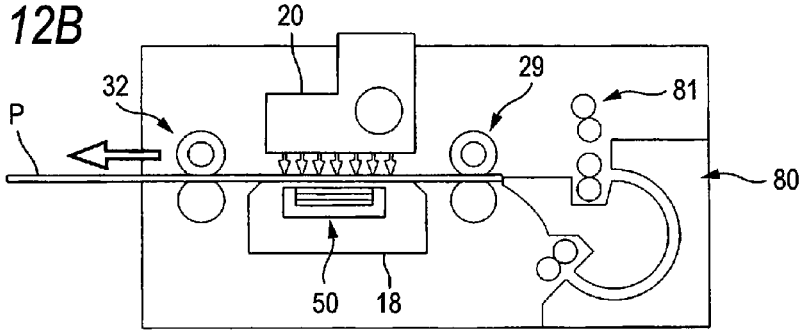
Figure 12C:
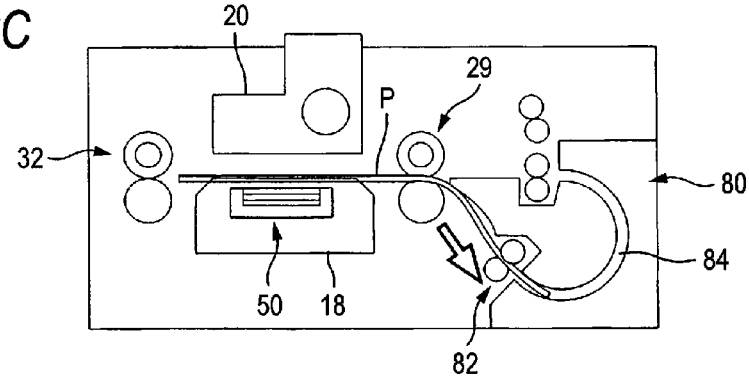
Figure 12D:
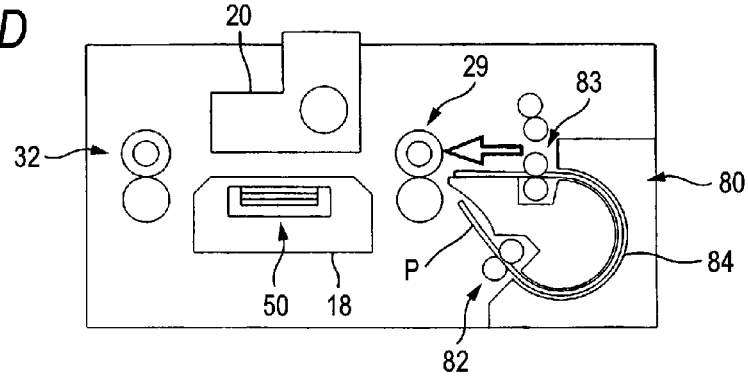

As shown in FIG. 12A, a recording paper P having been fed from the sheet feeding tray 5 (see FIG. 2) is guided to the front by the first roller pair 81 and is also guided by the guide 85 so as to be sent to the conveying roller pair 29. The conveying roller pair 29 rotates in one direction to convey the recording paper P further to the front, so as to locate the recording paper P within an image forming area 37 on the platen 18 with the recording paper P held by the sheet discharging roller pair 32 and the conveying roller pair 29 (see FIG. 12B). In this state, inks are ejected from the ejection head 20 to form an image on one side of the recording paper P.

When the image formation on the one side of the recording paper P is completed, the conveying roller pair 29 and the sheet discharging roller pair 32 rotates in the other direction to convey the recording paper P to the rear. The recording paper P conveyed to the rear is then guided to the second roller pair 82 by the guide 85 and is guided further from the entrance into the reversing path 84 by the second roller pair 82 (see FIG. 8C). The recording paper P passed through the reversing path 84 is conveyed to the front by the third roller pair 83 (refer to FIG. 8D) and is further guided into the image forming area 37 which faces the ejection head 20 again by the conveying roller pair 29. As this occurs, the recording paper P passed through the reversing path 84 is now reversed upside down and is located in the image forming area 37 in a state where the one side where the image has been first formed is oriented downwards (in a state where the other side is oriented upwards).

Figure 13A:
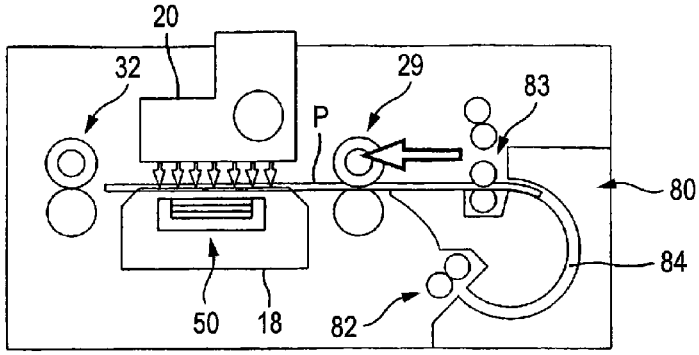
FIGS. 13A to 13D are exemplary diagrams which explain operations performed in the inkjet recording device shown in FIG. 11 when images are formed on both sides of the recording paper and the paper piece is attached thereto.
Figure 13B:
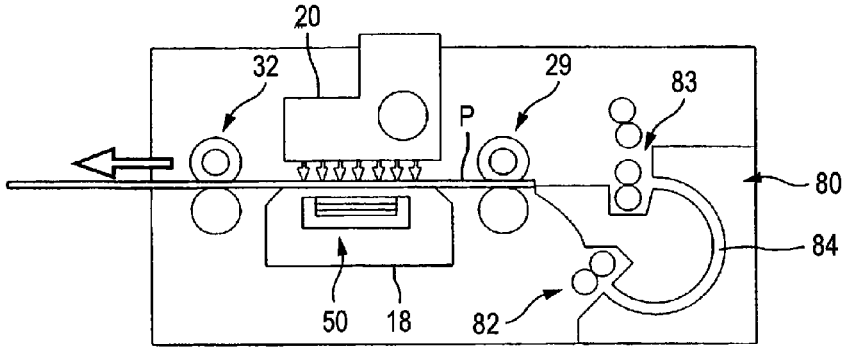
Figure 13C:
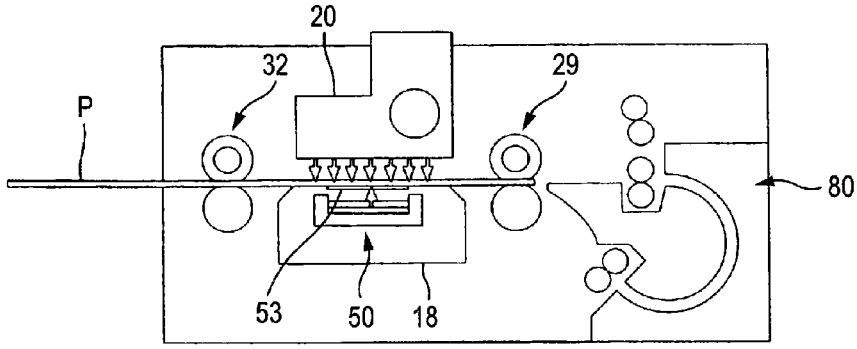
Figure 13D:
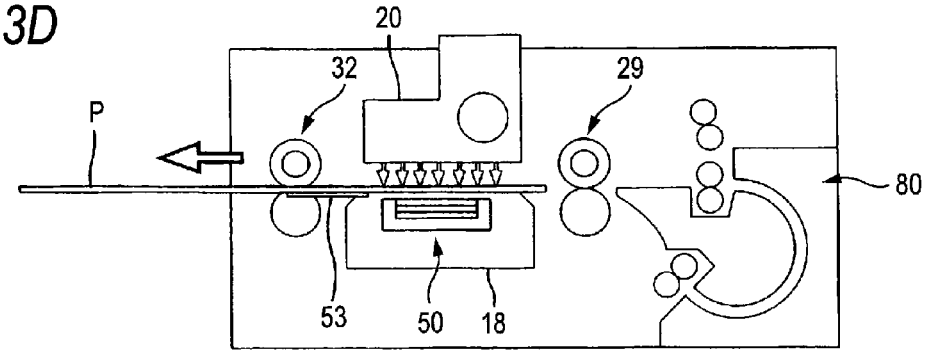

Next, as shown in FIG. 13A, an image is formed on the other side of the recording paper P while being conveyed by the conveying roller pair 29, and furthermore, the image is formed on the recording paper P also while being conveyed by the sheet discharging roller pair 32 (FIG. 13B). In addition, when the recording paper P has reached a position where a paper piece 53 is to be attached, a paper piece attaching unit 50 is driven to attach a paper piece 53 to a lower surface (one side) of the recording paper P, and then an image is formed on the attached paper piece 53 by ejecting inks from the ejection head 20 (see FIG. 13C). In addition, an image is formed on the remaining area on the other side of the recording paper P while the recording paper P is being fed forwards by the sheet discharging roller pair 32 (see FIG. 13D), and when the formation of all the images on the recording paper P is completed, the recording paper P is discharged to the sheet discharging tray 6, whereupon the series of operations is ended.

By operating the inkjet recording device 1 in the way described above, also in the inkjet recording device 1 having the double-side printing function, a paper piece 53 can be attached to a side end portion of a recording paper P and an image can be formed on the paper piece 53. In this inkjet recording device 1, an image can be formed on the paper piece 53 after the paper piece 53 has been attached to the recording paper P. On the contrary, the paper piece 53 may be attached to the recording paper P after the image has been formed on the paper piece 53. In either of the cases, a similar function and advantage to those provided by the inkjet recording device 1 shown in FIGS. 1 to 6 can be provided.

As disclosed above, various paper sizes can be used for the inkjet recording device 1. The recording paper P may be accommodated in the sheet feeding tray 5 so as to align one side (e.g., one width end) of the recording paper P of any paper sizes along a predetermined reference line, such that the one side of the recording paper P passes through a constant position with respect to the scanning direction relative to the paper piece attaching unit 50 during a conveyance of the recording paper P at the straight path 25 (see FIG. 2) of the sheet conveying path 23. Accordingly, the paper piece 53 can be appropriately attached to the recording paper P of any size. Incidentally, one example of an appropriate position of the paper piece attaching unit 50 relative to the recording sheet P includes a position where a predetermined region of the paper piece including at least the one end portion 53*a* overlaps with the recording sheet P in plan view, and the remaining region of the paper piece 53 including at least the other end portion exposes from the recording paper P such that an image can be recorded on the remaining region by the ejection head 20.

As another illustrative aspect, any alignments of the recording paper P such as a center alignment may be adopted to the sheet feeding tray 5. For example, the sheet feeding tray 5 with the center alignment is configured to accommodate therein the recording paper P to align a width center of the recording paper P of any size along a predetermined reference line. When the center alignment is adopted, the width center of the recording paper P passes through a constant position with respect to the scanning direction at the straight path 25. That is, the position of the one side of the recording paper P with respect to the scanning direction relative to the paper piece attaching unit 50 varies depending on the paper size. Therefore, when the center alignment is adopted, the paper piece attaching unit 50 is configured to move in the scanning direction to the appropriate positions corresponding to respective paper sizes.

Specifically, the inkjet recording device 1 of this illustrative aspect includes: a paper width sensor; the paper piece attaching unit 50 that is movable; a driving unit configured to drive the paper piece attaching unit 50. The paper width sensor, such as an optical sensor, may be disposed at the ejection head 20 provided on the carriage 19 and configured to detect the paper width (or width end position) of the recording paper P conveyed into the image forming area 37 and output the detection result to the control unit 60. The paper piece attaching unit 50 is slideably mounted to a rail that extends along the scanning direction (i.e., along the paper width direction), such that the paper piece attaching unit 50 is movable along the scanning direction. The driving unit includes an actuator or motor configured to adjust the position of the paper piece attaching unit 50 in response to control signal output from the control unit 60 based on the detection result of the paper width sensor. Accordingly, the paper piece attaching unit 50 can move to the appropriate positions corresponding to the respective paper sizes.

As still another illustrative aspect of the inkjet recording device 1 with the center alignment, the paper piece attaching unit 50 may be moved in response to a side guide provided at the sheet feeding tray 5. The side guide is configured to move along the width direction (corresponding to the scanning direction) so as to position the recording paper P accommodated in the sheet feeding tray 5. In this case, the inkjet recording device 1 includes a link member provided at the main body of the inkjet recording device 1, and a driving member attached to the paper piece attaching unit 50 and configured to adjust the position of the paper piece attaching unit 50. A part of the link member is positioned to be able to contact with a part of the side guide of the sheet feeding tray 5 when the sheet feeding tray 5 is mounted to the inkjet recording device 1. Another part of the link member is engaged with the driving member. When the link member contacts with the side guide, the link member slides or rotates according to the position of the side guide. As a result, the paper piece attaching unit 50 moves to the appropriate positions corresponding to the respective paper sizes based on the amount of the movement of the link member.

Although the above description shows the so-called tube type printer unit 2 in which images are formed in a state where the ejection head 20 and the sub-tank 41 are connected by the ink supply tube 42, the invention is not limited thereto. For example, the image forming device of the illustrative aspects may be applied to any types of the image recording device such as: a so-called station type (on-demand type) printer unit in which images are formed in a state where a sub-tank 41 (or main tanks 9) is not communicating with an ejection head 20, and the ejection head 20 is connected to the sub-tank 41 or the like as required when inks in the ejection head 20 decrease to a predetermined amount or less; an on-carriage type printer unit in which main tanks 9 are equipped in an upper portion of an ejection head 20; etc.

In addition, the above illustrative aspect shows the ejection head 20 movable along the scanning direction. However, instead of the movable ejection head, the image recording unit 22 may include a line head as the ejection head 20, which extends along the scanning direction and can perform an image recording operation for one line (or predetermined lines) along the scanning direction without performing a scanning operation of the ejection head 20 (i.e., without moving the ejection head 20 in the scanning direction).

According to the illustrative aspects of the invention, the ejection head 20 configured to eject ink on a recording paper P can also be used for forming an image on a paper piece 53 which has been or to be attached to the recording paper P. Therefore, the inkjet recording device 1 may include only one ejection head 20, which can realize a reduction in size of the device main body, as well as production cost of the device itself.

The attaching unit 50 may be provided within an image area 37 where an image can be formed by ink ejected from the ejection head 20. According to this configuration, the position where a paper piece 53 is attached to the recording paper P and the image forming position where an image is formed on a paper piece 53 substantially coincide with each other. Therefore, a distance can be shortened over which a recording paper P has to travel to the sheet discharging tray after a paper piece 53 has been attached thereto, which can prevent the detachment of the paper piece 53 from the recording paper P.

Additionally, the ejection head 20 may be configured so as to record an image on the paper piece 53 which has been attached to the recording paper P by the attaching unit 50. By adopting this configuration, the recording surface (the surface of a side where an image is formed) of the paper piece 53 becomes substantially flush with the recording paper P, an image can accurately be formed on the paper piece 53 by ink ejected from the same ejection head 20.

The ejection head 20 may be configured to record an image on the paper piece 53 which has not been attached to the recording paper P by the attaching unit 50. For example, in a case where one piece of sticky note (as an example of the paper piece 53) is separated from a stack of sticky notes (as an example of the paper piece stack 52) in which a plurality of sticky notes are stack and bonded one on top of the other via an adhesive material so as to be attached to a recording paper, the separated sticky note tends to be bent into a shape which curves with various curvatures. However, according to the configuration described above, an image can be formed on a sticky note that has not yet been separated from the stack of sticky notes, an accurate image can be formed on the sticky note, compared to a case where an image is formed on a sticky note which has already exhibited a curved shape due to separation from the stack of sticky notes. In addition, even before a paper piece 53 is attached to a recording paper P, an image can be formed on the paper piece 53 in advance by making use of a period of time in the middle of a document printing operation and during which no image is formed on the recording paper P.

The conveying unit may include a pair of rollers such as the sheet discharging roller pair 32 which hold the recording paper therebetween and rotate about axes which extend in the scanning direction of the image recording device, and the pair of rollers may be configured to hold therebetween the recording paper P together with the paper piece attached thereto. According to the configuration, the conveying unit can also be used for press-bonding a recording paper P and a paper piece 53 attached thereto together.

The inject recording device may have a double-side printing function, and the attaching unit 50 may be configured so as to attach the paper piece 53 to the recording paper P after an image has been recorded on one side of the recording paper P when images are to be recorded on both sides of the recording paper P. According to this configuration, the traveling distance of the recording paper P to which the paper piece 53 has been attached can be shortened, which can suppress the possibility of the paper piece 53 being separated and detached from the recording paper P. Namely, in case where the paper piece 53 is attached to the recording paper P before an image is formed on one side of the recording paper P, the paper piece 53 has to travel in a state where it is attached to the recording paper P from a time point before an image is formed on one side of the recording paper P via an image recording on the other side until a time point at which the paper piece 53 is discharged on the sheet discharging tray 6. The longer the traveling distance becomes, the larger the possibility becomes of the paper piece 53 being separated from the recording paper P on its way to the sheet discharging tray 6. According to the configuration described above, however, for example, the paper piece 53 is be attached to the recording paper P after an image is recorded on one side and before or after an image is recorded on the other side of the recording paper P. As a result, the traveling distance over which the paper piece 53 has to travel after the attachment thereof to the recording paper P is shortened, thereby making it possible reduce the possibility of the paper piece 53 being separated from the recording paper P.

The control unit 60 may control operations of the ejection head 20 and the head drive unit such as the ejection driver 61 such that ink is sequentially ejected from the ejection head on both the recording paper P and the paper piece 53 while the ejection head is being moved to one direction along the scanning direction by the head drive unit. According to this configuration, since both the formation of an image on the recording paper P and the formation of an image on the paper piece 53 can be implemented while the ejection head 20 performs scanning in one direction, both the image forming operations can be completed within a short period of time.

The inkjet recording device 1 may further include a storage unit such as RAM 66 configured to store positional information which indicates an attaching position on the recording paper with respect to the conveying direction, and the control unit 60 may control operations of the conveying unit and the attaching unit 50 such that the paper piece 53 is attached to the attaching position indicated by the positional information stored in the storage unit. According to this configuration, the position where a paper piece 53 is attached to a recording paper P can be set as required, thereby making it possible to facilitate the sort-out operation of a plurality of documents.

The attaching unit 50 may include: an accommodation portion such as the paper piece accommodation portion 51 configured to accommodate the paper piece 53 in which an adhesive material is applied to apart of a front surface thereof and which is disposed to face one side of the recording paper P; a sliding contact portion such as rotor 55 configured to be brought into slide-contact with the front surface of the paper piece P accommodated in the accommodation portion so as to bend the paper piece 53 in such a manner as to project towards a front surface side thereof; and an inserting portion such as the inserting rod 57 configured to be inserted along a rear surface side of a bent portion on the paper piece, and the attaching unit 50 may move the paper piece 53 away from the accommodation portion so that the paper piece 53 is attached to the one side of the recording paper by moving the inserting portion towards a portion of the paper piece 53 where the adhesive material is applied.

According to this configuration, only a single paper piece 53 can be picked up from a paper piece stack 52 in which a plurality of paper pieces 53 are attached one on top of the other so that the paper piece 53 is attached to a recording paper P through the simple configuration. In addition, since the sliding contact portion is configured to slide-contact with the front surface of a paper piece 53, only a single paper piece 53 with which the sliding contact portion is brought into slide-contact can be bent in an ensured fashion.

The accommodation portion may be configured to accommodate a paper piece stack 52 in which a plurality of paper pieces 53 are stacked, and the attaching unit 50 may further include a drive portion such as the bottom lifting portion 54 configured to move the paper piece stack 52 in a direction towards the recording paper P. According to this configuration, paper pieces 53 can properly be picked up one by one from the paper piece stack 52 and attached to recording papers P.

The sliding contact portion provided at the attaching unit 40 may include a rotatable rotor such as the rotor 55 having an outer circumferential surface adapted to be brought into slide-contact with the paper piece 53. According to this configuration, the sliding contact portion can be made by the simple configuration.

The sliding contact portion provided at the attaching unit 50 may be configured to move towards and away from the paper piece 53. According to this configuration, the sliding contact portion can move towards a paper piece 53 only when the paper piece is attached to a recording paper P, whereas when no such operation is required, the sliding contact portion can move away therefrom for retraction.

According to the inkjet recording device of the illustrative aspects, there can be provided an inkjet recording device with the reduced size of the main body and reduced production cost of the device. Also, the inkjet recording device can prevent the detachment of a paper piece 53 from the recording paper P, by providing an image forming position and an attaching position where a paper piece 53 is attached to the recording paper P near to each other.

What is claimed is:

1. An inkjet recording device comprising:

an ejection head configured to eject ink on a first recording medium to form an image;

a conveying unit configured to convey the first recording medium on a conveying path, the conveying path including a first conveying path positioned where the ejection head forms the image on the first recording medium and extending along a first direction;

an attaching unit configured to attach a second recording medium having an adherable part adherable to the first recording medium such that a part of the second recording medium projects from an end portion of the first recording medium with respect to a second direction perpendicular to the first direction; and a control unit configured to control the ejection head, the conveying unit, and the attaching unit, wherein the ejection head is configured to record an image on the second recording medium in a position outside the first recording medium with respect to the second direction, and wherein the attaching unit is provided within an area where the ink ejected from the ejection head is allowed to record an image.

2. The inkjet recording device according to claim 1, wherein the ejection head is configured to record an image on the second recording medium after the attaching unit attaches the second recording medium to the first recording medium.

3. The inkjet recording device according to claim 1, wherein the ejection head is configured to record an image on the second recording medium before the attaching unit attaches the second recording medium to the first recording medium.

4. The inkjet recording device according to claim 1, wherein the conveying unit comprises a pair of rollers configured to hold the first recording medium therebetween and rotate about axes extending along the second direction, the pair of rollers being configured to hold therebetween the first recording medium together with the second recording medium attached thereto.

5. The inkjet recording device according to claim 1, wherein the conveying unit is configured to, after an image is recorded on a first side of the first recording medium, convey the first recording medium so that a second side opposite to the first side faces the ejection head, wherein, when an image is to be recorded on the second side of the first recording medium, the attaching unit is configured to attach the second recording medium to the first recording medium after an image has been recorded on the first side of the first recording medium.

6. The inkjet recording device according to claim 1, further comprising a head drive unit configured to move the ejection head along a second direction when recording an image on the first recording medium.

7. The inkjet recording device according to claim 6, wherein the control unit is configured to control operations of the ejection head and the head drive unit such that, during the move of the ejection head in one direction along the second direction, ink is sequentially ejected on the first recording medium and the second recording medium from the ejection head.

8. The inkjet recording device according to claim 1, further comprising a storage unit configured to store positional information indicating an attaching position on the first recording medium in the first direction, wherein the control unit is configured to control operations of the conveying unit and the attaching unit such that the second recording medium is attached to the attaching position of the first recording medium indicated by the positional information stored in the storage unit.

9. The inkjet recording device according to claim 1, wherein the attaching unit comprises:

an accommodation portion disposed to face towards the conveying path and configured to accommodate the second recording medium of which an adhesive material is applied to a first portion of a first surface;

a sliding contact portion configured to slide-contact the first surface of the second recording medium accommodated in the accommodation portion to bend the second recording medium towards the conveying path; and an inserting portion configured to be inserted along a second surface side of a bent portion on the second recording medium, and wherein the attaching unit causes the second recording medium to move away from the accommodation portion to be attached to the first recording medium by moving the inserting portion towards the first portion of the second recording medium.

10. The inkjet recording device according to claim 9, wherein the accommodation portion is configured to accommodate a stack of the second recording media in which a plurality of second recording media are stacked, and wherein the attaching unit further comprises a drive portion configured to move the stack of second recording media towards the conveying path.

11. The inkjet recording device according to claim 10, wherein the drive portion comprises an elastic member configured to apply a force towards the first conveying path.

12. The inkjet recording device according to claim 9, wherein the sliding contact portion comprises a rotor having an outer circumferential surface configured to slide-contact the second recording medium.

13. The inkjet recording device according to claim 9, wherein the sliding contact portion is configured to move towards and away from the second recording medium.

14. The inkjet recording device according to claim 13, wherein the sliding contact portion is movable along the second direction.

* * * * *